US010122137B2

(12) United States Patent
Baker

(10) Patent No.: US 10,122,137 B2
(45) Date of Patent: Nov. 6, 2018

(54) PAD EXTENDING MEMBER

(71) Applicant: Hubbell Incorporated, Shelton, CT (US)

(72) Inventor: Barry Lynn Baker, Amelia, OH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/494,676

(22) Filed: Apr. 24, 2017

(65) Prior Publication Data

US 2017/0317457 A1 Nov. 2, 2017

Related U.S. Application Data

(60) Provisional application No. 62/328,898, filed on Apr. 28, 2016.

(51) Int. Cl.
*H01R 25/16* (2006.01)

(52) U.S. Cl.
CPC ..... *H01R 25/168* (2013.01); *H01R 25/162* (2013.01)

(58) Field of Classification Search
CPC ... H01R 4/36; H01R 4/38; H01R 4/64; H01R 4/66; H01R 13/621; H01R 13/6215; H01R 25/162; H01R 25/168
USPC ..... 439/11, 12, 32, 907
See application file for complete search history.

(56) References Cited

U.S. PATENT DOCUMENTS 2,232,602 A * 2/1941 Grace ..... H01R 4/363 174/88 S
5,281,761 A * 1/1994 Woo ..... H01R 4/643 174/78
5,688,131 A * 11/1997 Byfield, Jr. ..... H01R 4/64 439/883
6,361,375 B1 * 3/2002 Sinclair ..... H01R 25/006 439/721
6,431,885 B1 * 8/2002 Stroup ..... H01R 4/64 174/78
6,722,170 B2 * 4/2004 Squier ..... E05B 9/08 292/DIG. 53
6,837,754 B1 * 1/2005 Walton ..... H01R 11/12 439/798
6,866,154 B2 * 3/2005 Hartman ..... G06F 1/183 211/191
6,957,518 B1 * 10/2005 Koch, Jr. ..... E04C 3/30 248/300

(Continued)

*Primary Examiner* — Edwin A. Leon
*Assistant Examiner* — Oscar Jimenez
(74) *Attorney, Agent, or Firm* — Michael Best & Friedrich, LLP

(57) ABSTRACT

A pad extender for coupling a connector coupled to a conductor cable to a lug terminal member of a transformer. The pad extender includes a planar body having a first portion and a second portion. The first portion has a first axis. The pad extender further includes an elongated slot defined in the first portion of the planar body extending parallel to the first axis. The first portion is couplable to the lug terminal member via a first fastener extending through the slot. The planar body is slidable relative to the lug terminal member along a length of the elongated slot. The pad extender further includes a plurality of apertures defined in the second portion. The connector is couplable to the second portion via a second fastener extending through one of the apertures of the second portion.

21 Claims, 7 Drawing Sheets

(56) References Cited

U.S. PATENT DOCUMENTS

| | | | | |
|---|---|---|---|---|
| 6,971,926 | B1 * | 12/2005 | Walton | H01R 11/12 439/798 |
| 7,458,861 | B1 * | 12/2008 | Eke | H01R 4/64 439/798 |
| 7,462,042 | B2 * | 12/2008 | Chawgo | H01R 4/36 439/92 |
| 8,864,190 | B2 * | 10/2014 | Chang | H05K 7/1489 292/109 |
| 9,517,738 | B2 * | 12/2016 | Yamada | H01R 4/64 |
| 2011/0042136 | A1 * | 2/2011 | Lawrence | H01C 7/12 174/480 |
| 2013/0273771 | A1 * | 10/2013 | Byron | H01R 11/12 439/502 |

* cited by examiner

PAD EXTENDING MEMBER

CROSS-REFERENCE TO RELATED APPLICATION

This application claims priority to U.S. Provisional Patent Application No. 62/328,898, filed Apr. 28, 2016, the entire contents of which are incorporated herein by reference.

FIELD

The application relates to electrical connectors, and in particular, electrical connectors for connecting conductor cables to a transformer.

SUMMARY

When connecting conductor cables to a transformer, typically a connector is used to connect a conductor cable to a lug terminal spade or member extending from the transformer. The connector typically includes a cable clamping portion and a flat pad lug portion. The cable clamping portion receives a free end of the conductor cable and is tightened to couple the cable clamping portion to the free end of the conductor cable. The flat pad lug portion of the connector is couplable to the lug terminal member extending from the transformer via bolts received through connecting point apertures in the flat plate and the flat pad lug portion. When connected, the conductor cables are in electrical communication with the transformer. The flat pad lug portion may have any number of apertures and there may be any number of cable clamping portions for receiving any number of conductor cables. However, these types of connectors are constrained by the length of the conductor cable. Accordingly, often when an old transformer is replaced with a new transformer, the connecting point apertures of a flat plate of the lug terminal member extending from the new transformer are at different heights. In some cases, the conductor cable is not long enough to reach and be connected to the lug terminal member extending from the new transformer.

In one embodiment, the application provides a pad extender for coupling a connector coupled to a conductor cable to a lug terminal member of a transformer. The pad extender includes a planar body having a first portion and a second portion. The first portion has a first axis. The pad extender further includes an elongated slot defined in the first portion of the planar body extending parallel to the first axis. The first portion is couplable to the lug terminal member via a first fastener extending through the slot. The planar body is slidable relative to the lug terminal member along a length of the elongated slot. The pad extender further includes a plurality of apertures defined in the second portion. The connector is couplable to the second portion via a second fastener extending through one of the apertures of the second portion.

In another embodiment, the application provides a pad extender for connecting a conductor cable to a transformer. The pad extender includes a planar body having a first portion and a second portion. The first portion has a first axis. The pad extender further includes an elongated slot defined in the first portion of the planar body. The elongated slot extending parallel to the first axis. The pad extender further includes a plurality of apertures defined in the second portion of the planar body.

In yet another embodiment the application provides a method of coupling a connector coupled to a conductor cable to a lug terminal member of a transformer. The method includes aligning an elongated slot defined in a first portion of a pad extender with a first aperture defined in the lug terminal member. The slot extends parallel to a first axis of the first portion. The method further includes coupling the first portion of the pad extender to the lug terminal member. The method further includes coupling the connector to a second portion of the pad extender. The method further includes adjusting a position of the pad extender by sliding the pad extender relative to the lug terminal member along a length of the elongated slot.

Other aspects of the application will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
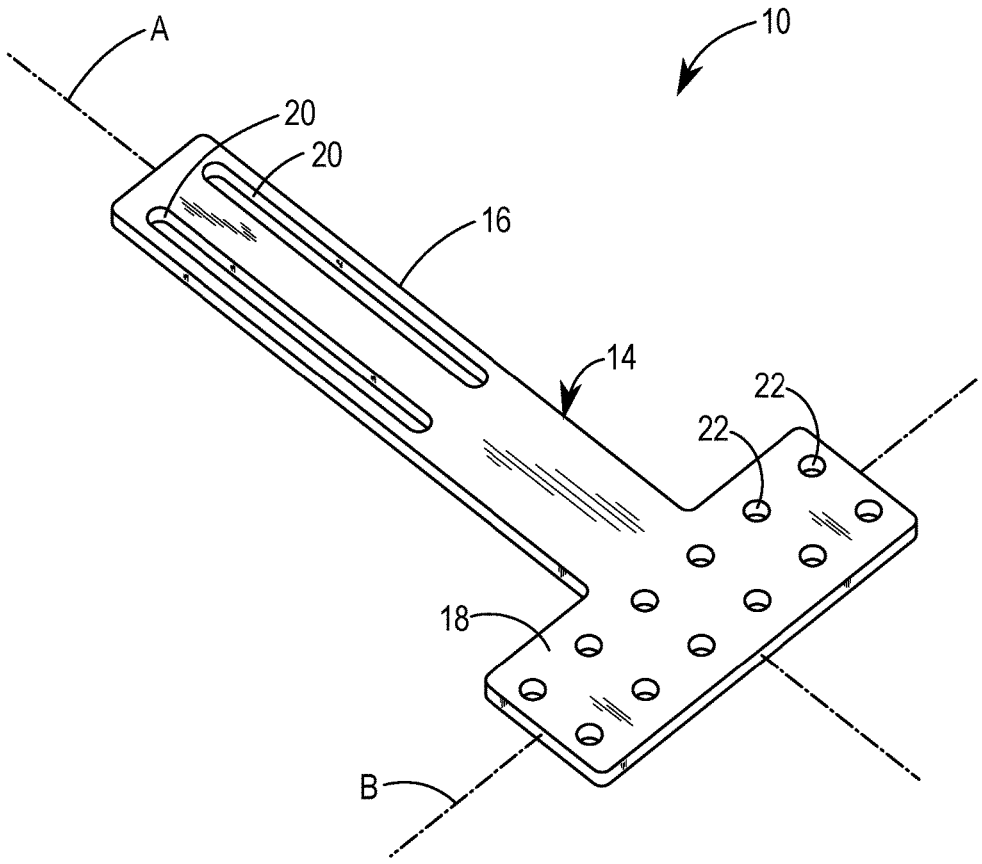
FIG. 1 is a perspective view of a pad extender in accordance with a first embodiment of the application.

FIG. 1 illustrates a pad extending member, or pad extender, 10 having a planar body 14. The planar body 14 includes a first portion 16 extending along a first axis A and a second portion 18 extending along a second axis B. In some embodiments, such as illustrated, the first portion 16 is connected substantially perpendicular to the first portion 16 at a center of the first portion 16 to form a substantial "T" shape. In other embodiments, the first and second portions 16, 18 may be arranged so that the first and second axes A, B intersect at any angle.

With continued reference to FIG. 1, the first portion 16 defines a pair of elongated slots 20 extending substantially parallel to the first axis A along a portion of the first portion 16. In the illustrated embodiment, the slots 20 extend along a portion of the first portion 16, however, in other embodiments, the slots 20 may extend along an entire length of the first portion 16 (e.g., the embodiments of FIGS. 3-5). In yet other embodiments, the first portion 16 may define one slot 20, or alternatively more than two slots 20. The second portion 18 defines a plurality of apertures 22. In some embodiments, the apertures 22 are arranged in two parallel rows of six. Additionally, as illustrated, in some embodiments, the plurality of apertures 22 include twelve apertures. In other embodiments, there may be any number of apertures 22 (e.g., the embodiments of FIGS. 3-5).

Figure 2:
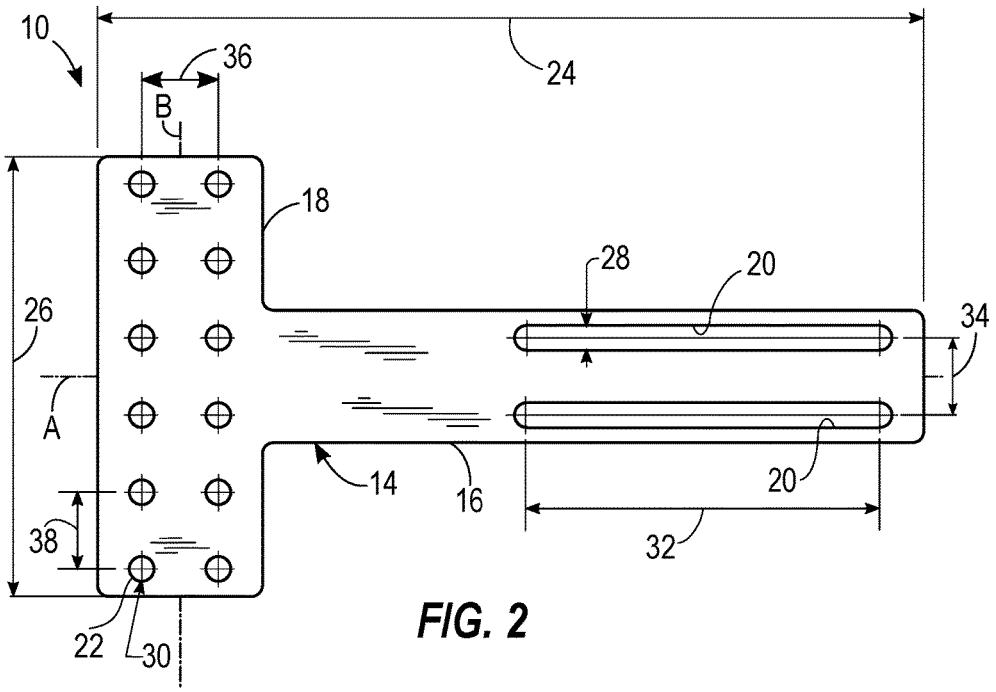
FIG. 2 is a planar view of the pad extender of FIG. 1 according to an embodiment of the application.

With reference to FIG. 2, the pad extender 10 has an overall length 24 of the first and second portions 16, 18 defined along the first axis A. In the illustrated embodiment, the overall length 24 is within a range of approximately 18 inches to approximately 19 inches (e.g., approximately 18.75 inches). In other embodiments, the overall length 24 may be any suitable length. The second portion 18 has a width 26 defined along the second axis B. In the illustrated embodiment, the width 26 of the second potion 18 is within a range of approximately 9 inches to approximately 11 inches (e.g, approximately 10 inches). In other embodiments, the width 26 of the second portion 18 may be any suitable width. The pad extender 10 further has a thickness within a range of approximately 0.1 inches to approximately 1 inch (e.g., approximately 0.5 inches). In other embodiments, the thickness may be another suitable thickness.

With continued reference to FIG. 2, each of the slots 20 has a slot width 28 and each of the apertures 22 has a diameter 30. In some embodiments, the slot width 28 of each of the slots 20 is substantially equal to the diameter 30 of each of the apertures 22. In the illustrated embodiment, the slot width 28 of each of the slots 20 and the diameter 30 of each of the apertures 22 is within a range of approximately 0.1 inches to approximately 1 inch (e.g., approximately 0.563 inches). In other embodiments, the slot width 28 of each of the slots 20 and the diameter 30 of each of the apertures 22 may be any suitable dimension.

Each of the slots 20 also has a slot length 32. In the illustrated embodiment, the slot length 32 of each of the slots 20 is within a range of approximately 7 inches to approximately 9 inches (e.g., approximately 8 inches). In other embodiments, the overall length may be another suitable length.

With continued reference to FIG. 2, the slots 20 are spaced by a slot spacing 34 transverse to the first axis A. The two parallel rows of apertures 22 are spaced by an aperture row spacing 36 transverse to the second axis B. The apertures 22 are spaced substantially parallel to the second axis B by an aperture column spacing 38. In the illustrated embodiment, the aperture row spacing 36 and the aperture column spacing 38 are each approximately equal to the slot spacing 34. In some embodiments, one or more of the aperture row spacing 36, the aperture column spacing 38, and the slot spacing 34 are dimensioned by a standard NEMA (National Electrical Manufacturers Association) designated spacing (e.g., 1.75 inches).

In some embodiments, the pad extender 10 may be made from copper (e.g., C110 Copper), aluminum (e.g., 6061-T6 Aluminum), or any other suitable conductive material. In some embodiments, the pad extender 10 is extruded. In some embodiments, the pad extender 10 may be tin plated.

Figure 3:
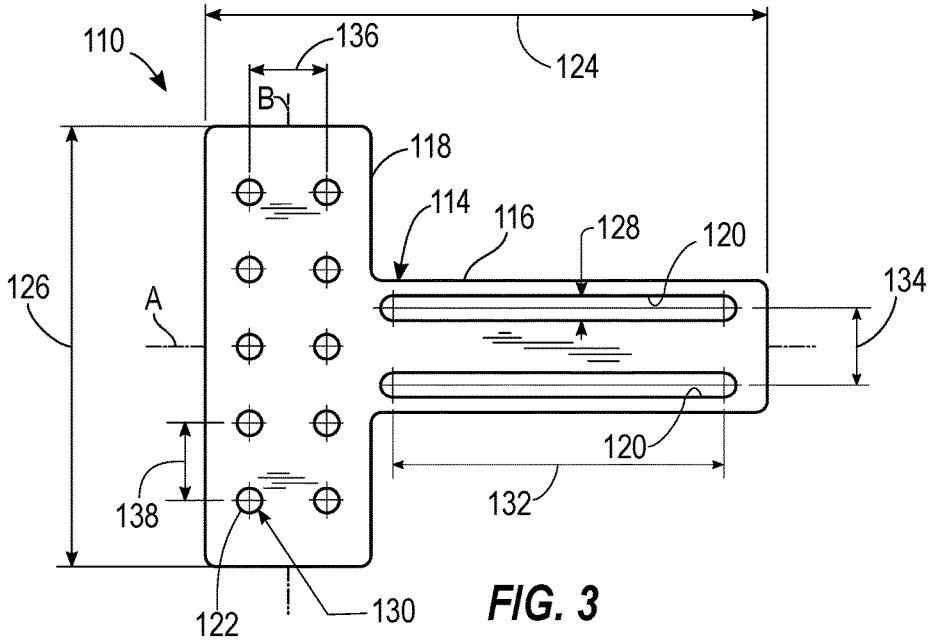
FIG. 3 is a planar view of a pad extender in accordance with a second embodiment of the application.
Figure 4:
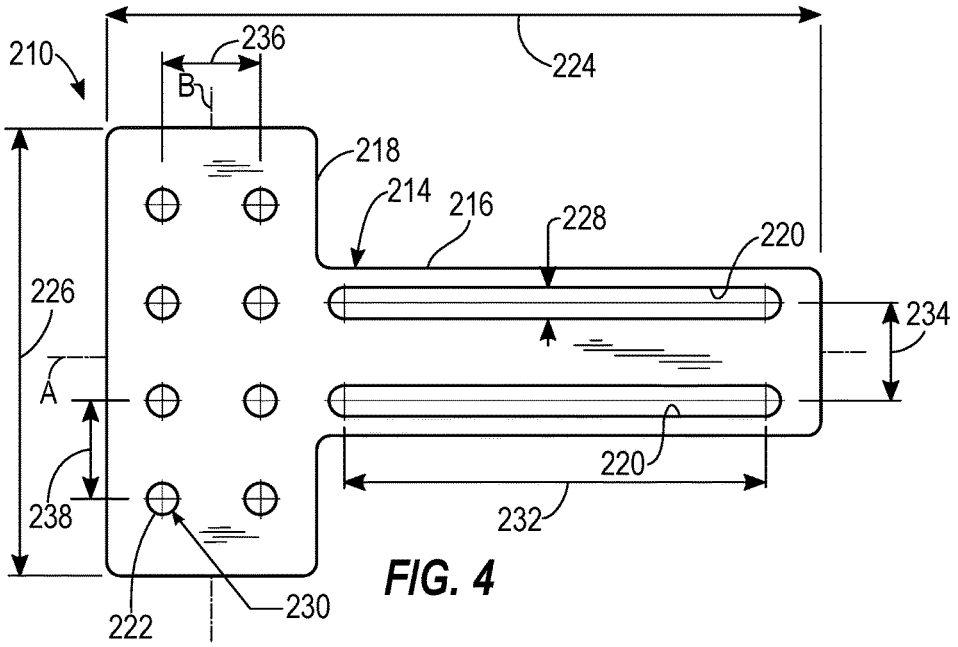
FIG. 4 is a planar view of a pad extender in accordance with a third embodiment of the application.
Figure 5:
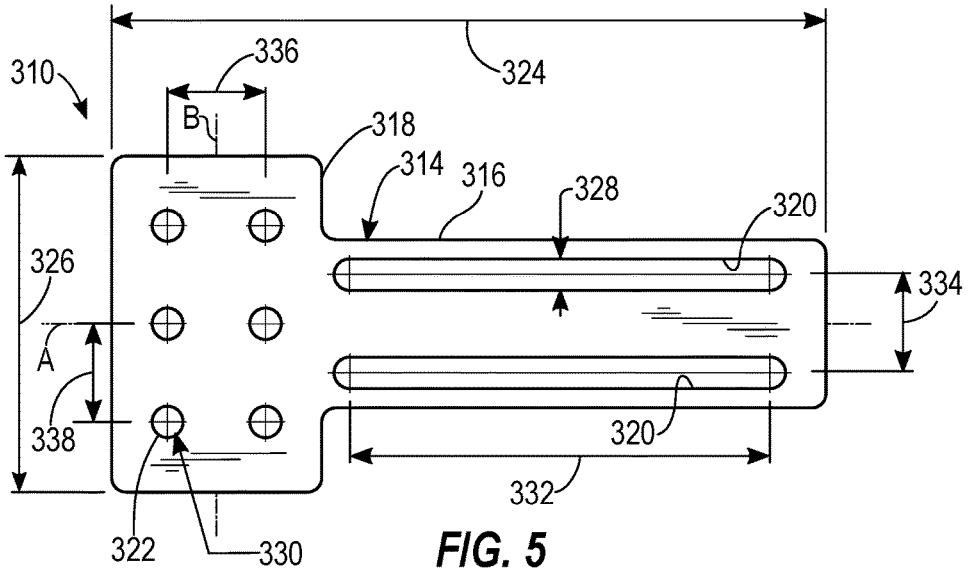
FIG. 5 is a planar view of a pad extender in accordance with a fourth embodiment of the application.

FIGS. 3-5 illustrate pad extenders 110, 210, 310 in accordance with other embodiments of the application. The pad extenders 110, 210, 310 are substantially similar to the pad extender 10 of FIGS. 1-2, and only differences are described in detail. Similar features are identified with like reference numerals plus 100, 200, and 300, respectively, and are not described again in detail.

With reference to FIG. 3, the overall length 124 of the pad extender 110 is within a range of approximately 10 inches to approximately 15 inches (e.g., approximately 12.75 inches). The width 126 of the second portion 118 of the pad extender 110 is within a range of approximately 9 inches to approximately 11 inches (e.g., approximately 10 inches). The second portion 118 defines ten apertures 122, arranged in two rows of five. The slots 120 extend the approximate length of the first portion 118. The slot length 132 of each of the slots 120 is within a range of approximately 6 inches to approximately 9 inches (e.g., approximately 7.5 inches).

Dimensions of the pad extender 210 of FIG. 4 are substantially identical to dimensions of the pad extender 110 of FIG. 3. However, the width 226 of the second portion 218 of the pad extender 210 is within a range of approximately 7 inches to approximately 9 inches (e.g., approximately 8 inches). In addition, the second portion 218 of the pad extender 210 of FIG. 4 defines eight apertures 222, arranged in two rows of four.

Dimensions of the pad extender 310 of FIG. 5 are substantially identical to the dimensions of the pad extender 110 of FIG. 3. However, the width 326 of the second portion 318 of the pad extender 310 is within a range of approximately 5 inches to approximately 7 inches (e.g., approximately 6 inches). In addition, the second portion 318 of the pad extender 310 of FIG. 5 defines six apertures 322, arranged in two rows of three.

Figure 6:
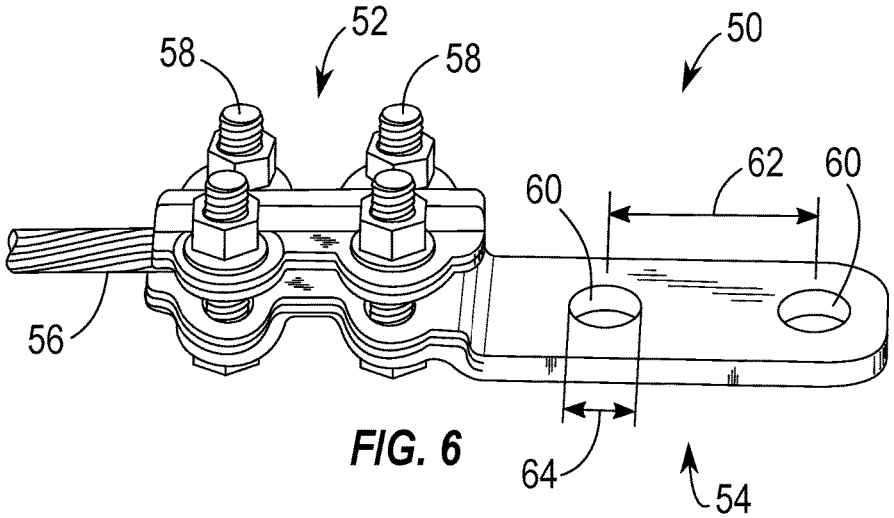
FIG. 6 is a perspective view of a conductor cable connector according to an embodiment of the application.

FIG. 6 illustrates a connector 50 that includes a cable clamping portion 52 and a flat pad lug portion 54. The cable clamping portion 52 is configured to receive a free end of a conductor cable 56. The cable clamping portion 52 is securely coupled to the free end of the conductor cable 56 by tightening clamping portion fasteners 58. The flat pad lug portion 54 defines two connector apertures 60 that are spaced by a connector aperture spacing 62 that is approximately equal to the aperture row spacing 36 and the aperture column spacing 38 of the pad extender 10. Each of the connector apertures 60 has a diameter 64 approximately equal to the diameter 30 of the apertures 22 of the pad extender 10. The connector 50 may be made from a bronze or aluminum alloy, or made from any other suitable conductive material. The connector 50 of FIG. 6 is merely exemplary and may take any number of configurations. For example, the flat pad lug portion 54 may define any number of connector apertures 60 and the cable clamping portion 52 may be coupled to the free end of the conductor cable 56 by another suitable method. In some embodiments, the cable clamping portion 52 may be replaced with a welded portion to connect the free end of the conductor cable 56 via welding, or a compression portion to connect the free end of conductor cable 56 via a compression fit.

Figure 7:
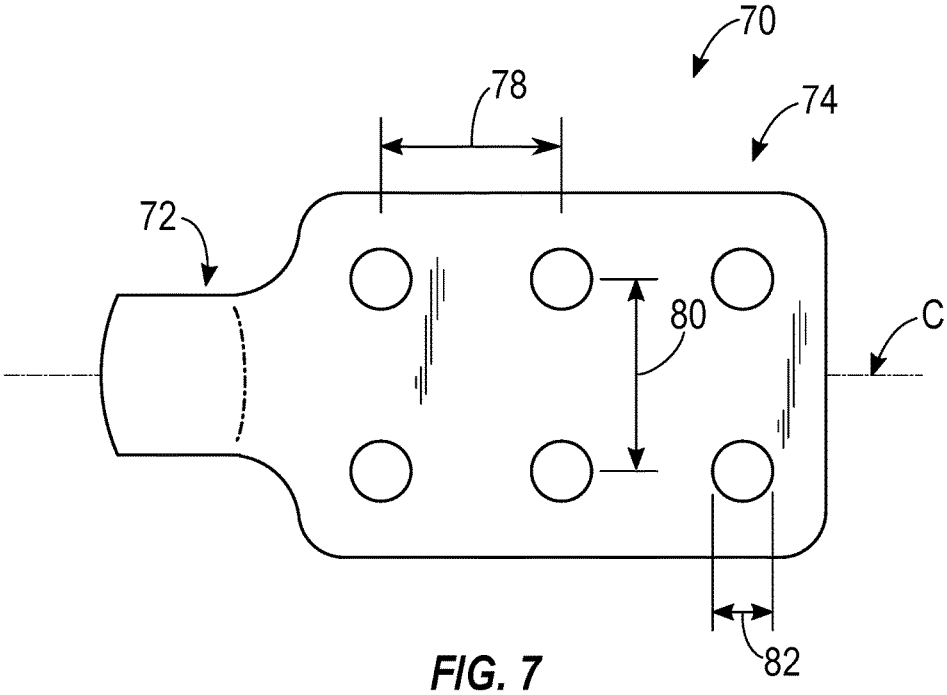
FIG. 7 is a planar view of a lug terminal member of a transformer according to an embodiment of the application.
Figure 8:
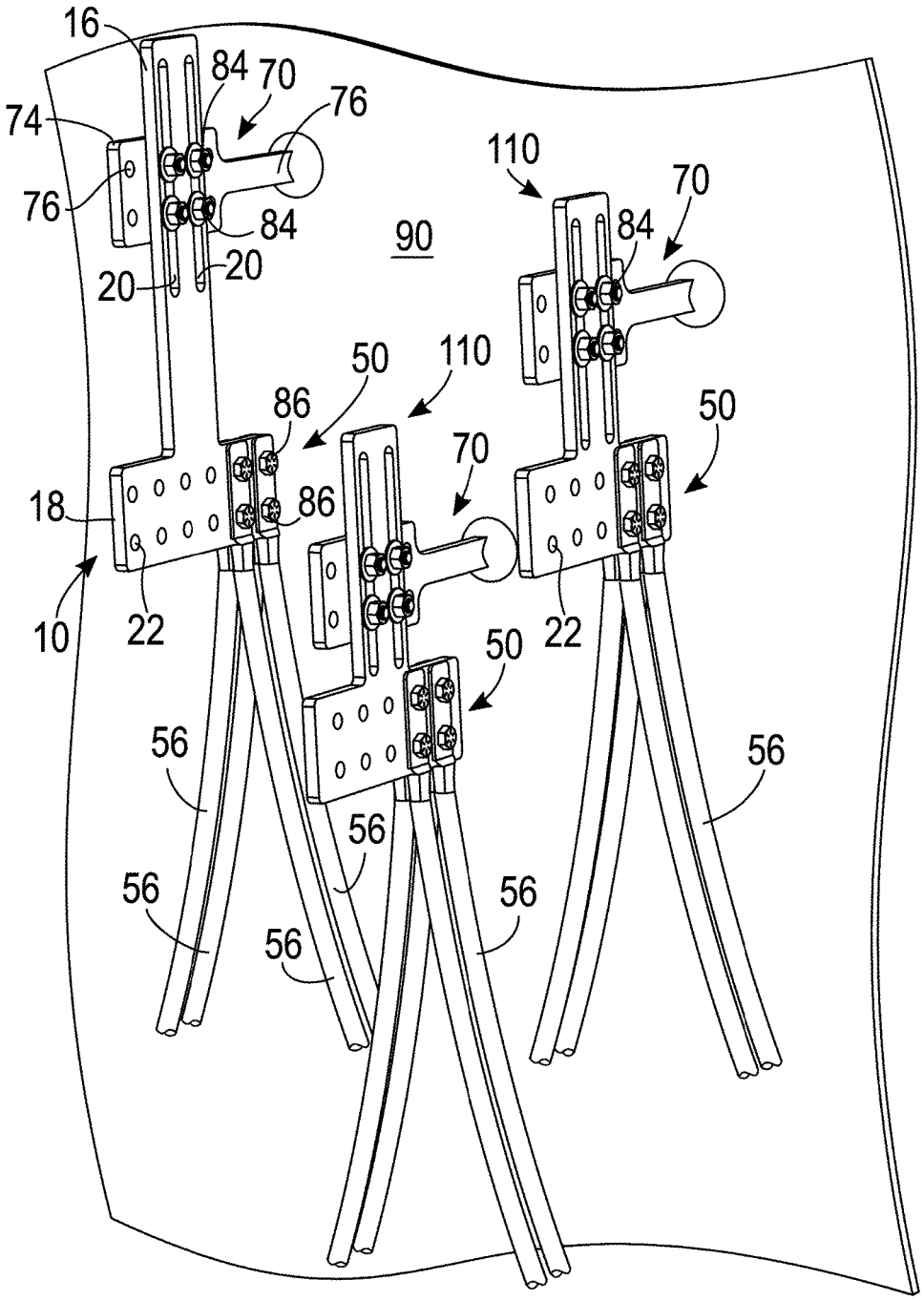
FIG. 8 shows multiple pad extenders connecting conductors to lug terminal members of a transformer according to an embodiment of the application.

FIG. 7 illustrates a lug terminal spade or member 70 that has an attachment portion 72 and a flat plate portion 74. The attachment portion 72 connects the lug terminal member 70 to a transformer 90 (FIG. 8), such that the flat plate portion 74 of the lug terminal member 70 extends from the transformer 90, as shown in FIG. 8. The flat plate portion 74 defines a plurality of terminal apertures 76 that act as connecting points for the lug terminal member 70. In the illustrated embodiment, the terminal apertures 76 are arranged in two rows of three terminal apertures 76 spaced along a longitudinal axis C of the lug terminal member 70 by a terminal aperture column spacing 78. The terminal aperture column spacing 78 is equal to the slot spacing 34 of the pad extender 10. The two rows of the terminal apertures 76 is spaced by a terminal aperture row spacing 80 terminal aperture row spacing 80 equal to the connector aperture spacing 62 of the connector 50. In addition, each of the terminal apertures 76 has a diameter 82 that is equivalent to the slot width 28 of the slots 20 (i.e., equivalent to the diameter 64 of the connector apertures 60, and the diameter 30 of the apertures 22 of the second portion 16). The lug terminal member 70 may be cast from a bronze or aluminum alloy and be tin plated, or made from any other suitable conductive material. The lug terminal member 70 of FIG. 7 is merely exemplary and may be in any one of various forms. For example, in some embodiments, the flat plate portion 74 may define any number of terminal apertures 76.

Referring to FIG. 8, during replacement of a transformer with a replacement transformer 90, often a height of the lug terminal members 70 of the replacement transformer 90 does not match the original transformer. This often results in the conductor cables 56 being too short to reach the lug terminal members 70, such that the connector apertures 60 of the connectors 50 cannot be aligned with the terminal apertures 76 of the lug terminal member 70 and be coupled together by fasteners received through the apertures 60, 76. Although operation is discussed below with reference to pad extender 10, any other embodiment (e.g., pad extender 110, 210, and 310) may also be used in conjunction with replacement of a transformer with a replacement transformer 90.

In order to couple the conductor cable 56 to the replacement transformer 90 without splicing in additional conductor cable, each of the slots 20 of the first portion 16 of the pad extender 10 is aligned with one of two columns of the terminal apertures 76 of the flat plate portion 74 of the lug terminal member 70. Once aligned, the slots 20 and the terminal apertures 76 may receive first fasteners 84 (e.g., bolts) to couple the first portion 16 of the pad extender 10 to the flat plate portion 74 of the lug terminal member 70.

The connector 50 may be coupled to the free end of the conductor cable 56 by the cable clamping portion 52. The connector apertures 60 of the connector 50 may then be aligned with two vertically aligned apertures 22 of the second portion 18 of the pad extender 10. Once aligned, the connector apertures 60 of the flat pad lug portion 54 and the apertures 22 of the second portion 18 of the pad extender 10 may receive second fasteners 86 (e.g., bolts) to couple the connector 50 to the second portion 18 of the pad extender 10.

Figure 9:
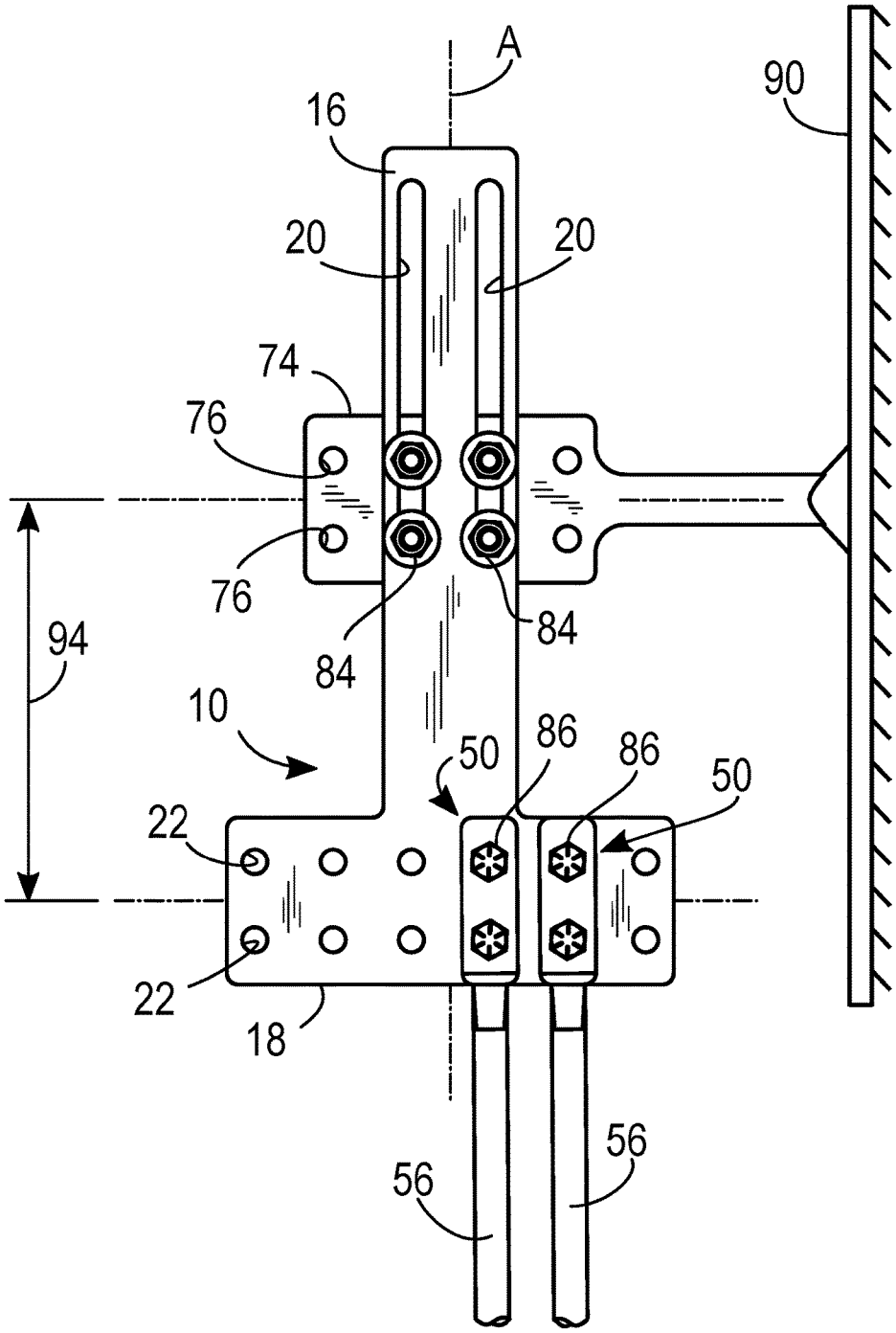
FIG. 9 is a schematic view of a pad extender connecting conductors to a lug terminal member of a transformer, with the pad extender in an upper position.
Figure 10:
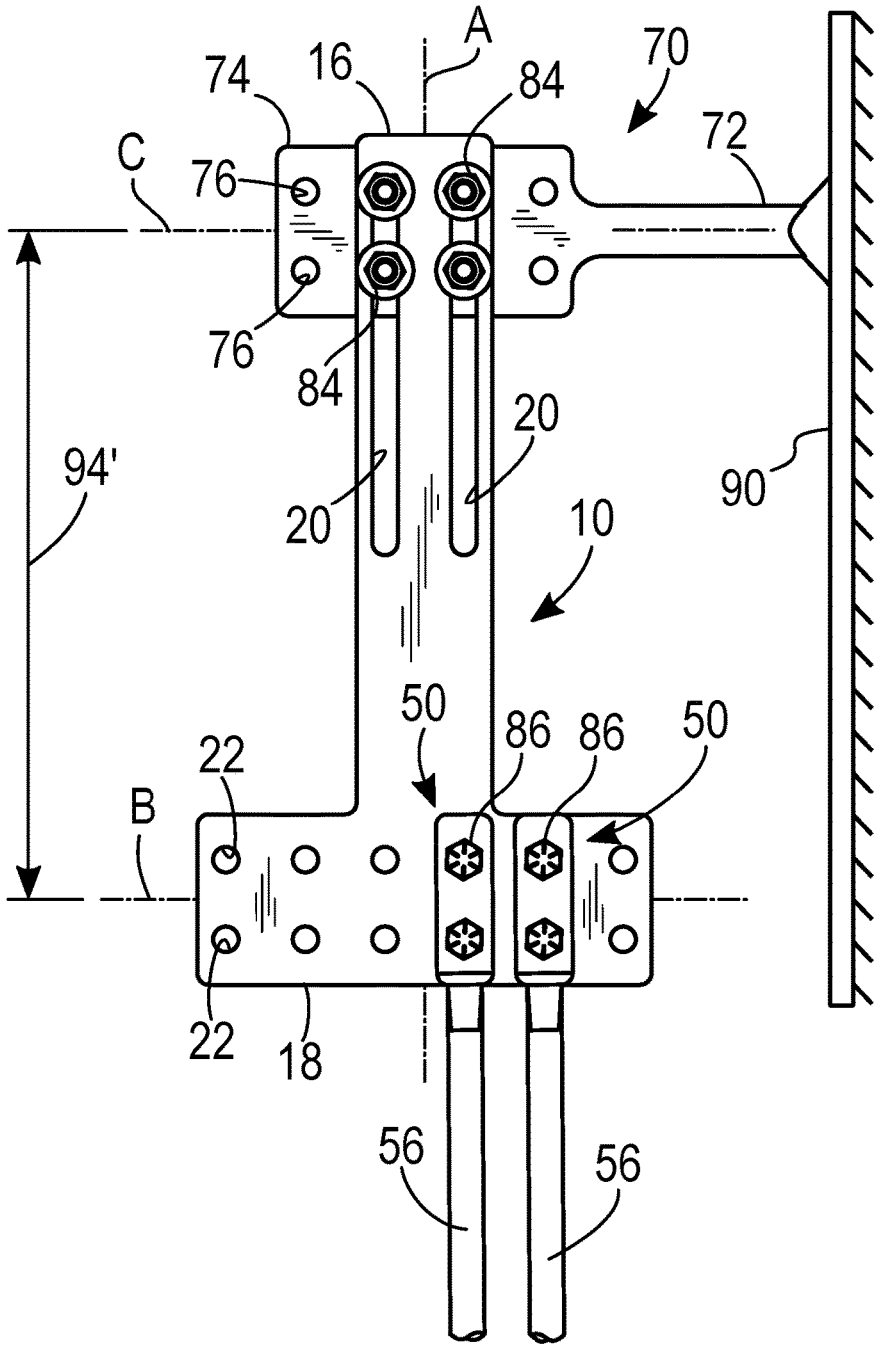
FIG. 10 is a schematic view showing the pad extender of FIG. 9 connecting conductors to the lug terminal, with the pad extender in a lower position.

However, if the connector 50 does not reach the second portion 18 of the pad extender 10 such that the connector apertures 60 of the flat pad lug portion 54 cannot be aligned with two vertically aligned terminal apertures 76 of the lug terminal member 70, a position of the pad extender 10 may be adjusted by sliding the pad extender 10 relative to the lug terminal member 70 along the slots 20 between an upper position relative to the lug terminal member 70 (see FIG. 9) and a lower position relative to the lug terminal member 70 (see FIG. 10). Accordingly, a position of the apertures 22 of the second portion 18 may be adjusted by the length 24 of the slots 20 to accommodate for a new height of the lug terminal member 70. The first fasteners 84 may be loosened to allow sliding of the pad extender 10 relative to the lug terminal member 70 and tightened to secure the pad extender 10 to the lug terminal member 70 in the desired position.

Alternatively, the connector 50 may be connected to the second portion 18 of the pad extender 10 via the second fasteners 86 before connecting the first portion 16 of the pad extender 10 to the lug terminal member 70 via the first fasteners 84 extending through the slots 20.

Once the first portion 16 of the pad extender 10 is coupled to the flat plate portion 74 of the lug terminal member 70 and the connector 50 is coupled to the second portion 18 of the pad extender 10, an electrical connection between the conductor cable 56 and the transformer 90 is established.

Additionally, in some embodiments, when the pad extender 10 is coupled to the lug terminal member 70, the first axis A of the first portion 16 extends substantially perpendicular to the longitudinal axis C of the lug terminal member 70, while the second axis B of the second portion 18 extends substantially parallel to and offset from the longitudinal axis C of the lug terminal member 70. This allows the connectors 50 to be aligned with the apertures 22 of the second portion 18 in the same orientation as if they were aligned with the terminal apertures 76 of the lug terminal member 70. Accordingly, an offset distance 94 (FIG. 9) between the longitudinal axis C of the lug terminal member 70 and the second axis B of the second portion 18 (i.e., an offset distance between the terminal apertures 76 and the apertures 22 of the second portion 18) is adjustable (i.e., increased or decreased) by sliding the pad extender 10 along the slots 20. For example, in the upper position (FIG. 9), the second axis B of the second portion 18 is spaced from the longitudinal axis C of the lug terminal member 70 by a first offset distance 94, and in the lower position (FIG. 10), the second axis B of the second portion 18 is spaced from the longitudinal axis C of the lug terminal member 70 by a second offset distance 94'. The first offset distance 94 is less than the second offset distance 94'.

Although not shown, in some embodiments, stacking-type terminal lugs can also be used where more conductor connections are required than available mounting positions.

In addition, the pad extender may be made to meet performance requirements of ANSI C119.4.

In general, the pad extender includes a pair of slots that allow the pad extender to be adjusted up and down, eliminating the need for splicing in additional conductor cable to the existing conductor cable to increase the conductor cables length.

Although aspects have been described in detail with reference to certain preferred embodiments, variations and modifications exist within the scope and spirit of one or more independent aspects as described. Further information concerning additional embodiments of the application may be found in the attached Appendix. Various features and advantages are set forth in the following claims.

What is claimed is:

1. A pad extender for coupling a connector coupled to a conductor cable to a lug terminal member of a transformer, the pad extender comprising:

a planar body including a first portion and a second portion, the first portion having a first axis;

an elongated slot defined in the first portion of the planar body extending parallel to the first axis, the first portion couplable to the lug terminal member via a first fastener extending through the elongated slot, the planar body slidable relative to the lug terminal member along a length of the elongated slot; and a plurality of apertures defined in the second portion, the connector couplable to the second portion via at least one second fastener extending through at least one of the apertures of the second portion.

2. The pad extender of claim 1, wherein the elongated slot is a first elongated slot, and further comprising a second elongated slot defined in the first portion of the planar body extending parallel to the first elongated slot.

3. The pad extender of claim 2, wherein the first slot and the second elongated slot are spaced by a first distance transverse to the first axis, wherein the distance is equal to a second distance between first and second connecting point apertures defined by the lug terminal member, and wherein the first fastener extends through the first connecting point aperture and a third fastener extends through the second slot and the second connecting point aperture.

4. The pad extender of claim 1, wherein when the first portion is coupled to the lug terminal member, the first axis of the first portion is perpendicular to a longitudinal axis of the lug terminal and a second axis of the second portion is parallel to and offset from the longitudinal axis of the lug terminal member.

5. The pad extender of claim 4, wherein a distance between the second axis of the second portion and the longitudinal axis of the terminal lug member is increased or decreased by sliding the planar body along the length of the elongated slot.

6. The pad extender of claim 1, wherein the plurality of apertures include at least two apertures spaced apart transverse to the first axis of the first portion of the planar body.

7. The pad extender of claim 1, wherein the plurality of apertures include at least two apertures spaced apart parallel to the first axis of the first portion of the planar body.

8. The pad extender of claim 1, wherein the first axis of the first portion is perpendicular with a second axis of the second portion.

9. The pad extender of claim 8, wherein the plurality of apertures include at least two apertures spaced apart parallel to the first axis and at least two apertures spaced apart parallel to the second axis.

10. A pad extender for connecting a conductor cable to a transformer, the pad extender comprising: a planar body including a first portion and a second portion, the first portion having a first axis; an elongated slot defined in the first portion of the planar body, the slot extending parallel to the first axis; and a plurality of apertures defined in the second portion of the planar body; wherein the planar body is slidable relative to the transformer along the first axis.

11. The pad extender of claim 10, wherein the slot is a first elongated slot, and further comprising a second elongated slot defined in the first portion of the planar body extending parallel to the first slot.

12. The pad extender of claim 10, wherein the first and second slots are spaced apart by a first distance equal to a second distance between two of the apertures in a direction transverse to the first axis.

13. The pad extender of claim 10, wherein the plurality of apertures include at least two apertures spaced apart transverse to the first axis of the first portion of the planar body.

14. The pad extender of claim 10, wherein the plurality of apertures include at least two apertures spaced apart parallel to the first axis of the first portion of the planar body.

15. The pad extender of claim 10, wherein the first axis of the first portion is substantially perpendicular with a second axis of the second portion.

16. The pad extender of claim 15, wherein the plurality of apertures include at least two apertures spaced apart parallel to the first axis and at least two apertures spaced apart parallel to the second axis.

17. The pad extender of claim 10, wherein the first portion and the second portion of the planar body generally form a "T" shape.

18. A method of coupling a connector coupled to a conductor cable to a lug terminal member of a transformer, the method comprising:

aligning an elongated slot defined in a first portion of a pad extender with a first aperture defined in the lug terminal member, the slot extending parallel to a first axis of the first portion;

coupling the first portion of the pad extender to the lug terminal member;

coupling the connector to a second portion of the pad extender; and adjusting a position of the pad extender by sliding the pad extender relative to the lug terminal member along a length of the elongated slot.

19. The method of claim 18, further comprising aligning a second aperture defined in the second portion of the pad extender with a third aperture defined in the connector.

20. The method of claim 18, wherein adjusting the position of the pad extender by sliding the pad extender relative to the lug terminal member along the length of the elongated slot includes adjusting a distance between a second axis of the second portion and a third axis of the lug terminal member, and wherein the second axis of the second portion is substantially parallel with the third axis of the lug terminal member.

21. The method of claim 18, wherein the elongated slot is a first elongated slot, and further comprising aligning a second elongated slot defined in the first portion of the pad extender with a second aperture defined the lug terminal member, and wherein the second elongated slot is parallel with the first elongated slot.

* * * * *